US010602769B2

(12) United States Patent
Fuisz

(10) Patent No.: US 10,602,769 B2
(45) **Date of Patent: *Mar. 31, 2020**

(54) SMOKELESS TOBACCO PRODUCT

(71) Applicant: Philip Morris Products S.A., Neuchatel (CH)

(72) Inventor: Richard C. Fuisz, Bay Harbor, FL (US)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 196 days.

This patent is subject to a terminal disclaimer.

(21) Appl. No.: 15/800,473

(22) Filed: Nov. 1, 2017

(65) Prior Publication Data

US 2018/0084820 A1 Mar. 29, 2018

Related U.S. Application Data

(63) Continuation of application No. 12/494,960, filed on Jun. 30, 2009, now Pat. No. 9,848,634.

(51) Int. Cl.

| | |
|---|---|
| ***A24B 15/14*** | (2006.01) |
| ***A24B 15/24*** | (2006.01) |
| ***A24B 15/30*** | (2006.01) |
| ***A24B 13/00*** | (2006.01) |

(52) U.S. Cl.

CPC ..... *A24B 15/14* (2013.01); *A24B 13/00* (2013.01); *A24B 15/245* (2013.01); *A24B 15/30* (2013.01)

(58) Field of Classification Search

CPC ..... A24B 15/14; A24B 13/00; A24B 15/30; A24B 15/245

See application file for complete search history.

(56) References Cited

U.S. PATENT DOCUMENTS

| | | | | |
|---|---|---|---|---|
| 3,085,580 | A | 4/1963 | Muth | |
| 4,855,326 | A | 8/1989 | Fuisz | 514/777 |
| 4,872,821 | A | 10/1989 | Weiss | 425/9 |
| 4,873,085 | A | 10/1989 | Fuisz | 424/400 |
| 4,997,856 | A | 3/1991 | Fuisz | 514/777 |
| 5,011,532 | A | 4/1991 | Fuisz | 106/215 |
| 5,028,632 | A | 7/1991 | Fuisz | 514/772 |
| 5,034,421 | A | 7/1991 | Fuisz | 514/772 |
| 5,096,492 | A | 3/1992 | Fuisz | 106/215 |
| 5,196,199 | A | 3/1993 | Fuisz | 424/401 |
| 5,236,734 | A | 8/1993 | Fuisz | 426/641 |
| 5,238,696 | A | 8/1993 | Fuisz | 426/565 |
| 5,268,110 | A | 12/1993 | Fuisz | 210/693 |
| 5,279,849 | A | 1/1994 | Fuisz et al. | 426/658 |
| 5,286,513 | A | 2/1994 | Fuisz | 426/641 |
| 5,288,508 | A | 2/1994 | Fuisz | 426/5 |
| 5,348,758 | A | 9/1994 | Fuisz et al. | 426/660 |
| 5,370,881 | A | 12/1994 | Fuisz | 426/5 |
| 5,374,447 | A | 12/1994 | Fuisz | 426/641 |
| 5,380,473 | A | 1/1995 | Bogue et al. | 264/11 |
| 5,387,431 | A | 2/1995 | Fuisz | 426/658 |
| 5,407,676 | A | 4/1995 | Fuisz | 424/401 |
| 5,422,136 | A | 6/1995 | Fuisz | 426/658 |
| 5,427,804 | A | 6/1995 | Fuisz | 426/99 |
| 5,427,811 | A | 6/1995 | Fuisz et al. | 426/465 |
| 5,429,836 | A | 7/1995 | Fuisz | 426/601 |
| 5,431,950 | A | 7/1995 | Fuisz | 426/641 |
| 5,447,423 | A | 9/1995 | Fuisz et al. | 425/9 |
| 5,456,932 | A | 10/1995 | Fuisz et al. | 426/548 |
| 5,472,731 | A | 12/1995 | Fuisz | 426/641 |
| 5,490,993 | A | 2/1996 | Fuisz | 426/92 |
| 5,501,858 | A | 3/1996 | Fuisz | 424/439 |
| 5,503,862 | A | 4/1996 | Fuisz et al. | 426/548 |
| 5,516,537 | A | 5/1996 | Fuisz | 426/100 |
| 5,518,551 | A | 5/1996 | Battist et al. | 127/58 |
| 5,518,730 | A | 5/1996 | Fuisz | 424/426 |
| 5,567,439 | A | 10/1996 | Myers et al. | 424/486 |
| 5,576,042 | A | 11/1996 | Fuisz | 426/548 |
| 5,587,172 | A | 12/1996 | Cherukuri et al. | 424/401 |
| 5,593,502 | A | 1/1997 | Fuisz et al. | 127/30 |
| 5,597,416 | A | 1/1997 | Fuisz et al. | 127/30 |
| 5,597,608 | A | 1/1997 | Fuisz | 426/658 |
| 5,601,076 | A | 2/1997 | Battist et al. | 127/58 |
| 5,622,717 | A | 4/1997 | Fuisz | 424/488 |
| 5,622,719 | A | 4/1997 | Myers et al. | 424/488 |
| 5,624,684 | A | 4/1997 | Fuisz | 424/484 |
| 5,651,987 | A | 7/1997 | Fuisz | 424/488 |
| 5,654,003 | A | 8/1997 | Fuisz et al. | 424/469 |
| 5,709,876 | A | 1/1998 | Fuisz | 424/439 |

(Continued)

FOREIGN PATENT DOCUMENTS

| | | | |
|---|---|---|---|
| EP | 0746342 | A1 | 12/1996 |
| JP | 7-507548 | A | 8/1995 |

(Continued)

OTHER PUBLICATIONS

Swedish Match; "Nicotine Uptake: Nicotine Uptake from Snus"; www.swedishmatch.com; pp. 4, Apr. 27, 2010.

Office Action of Korean Appln. No. 10-2012-7001361 dated May 30, 3017 with English translation.

International Search Report and Written Opinion PCT/US2010/040382 dated Dec. 28, 2010.

(Continued)

*Primary Examiner* — Michael H. Wilson

*Assistant Examiner* — Dionne W. Mayes

(74) *Attorney, Agent, or Firm* — Fitch, Even, Tabin & Flannery, LLP

(57) ABSTRACT

A melt spun tobacco composition, e.g., in flake or particle form, for oral use in a mammal made by melt spinning comprising tobacco and/or a tobacco extract and at least one material which is solid at room temperature, which melts at or below 500° F., and carries from 1% to 70% of tobacco when processed through melt spinning, and solidifies again in less than 5 seconds after melt spinning.

19 Claims, 1 Drawing Sheet

(56) References Cited

U.S. PATENT DOCUMENTS

| | | | | |
|---|---|---|---|---|
| 5,728,397 | A | 3/1998 | Fuisz | 424/439 |
| 5,733,577 | A | 3/1998 | Myers et al. | 424/488 |
| 5,811,123 | A | 9/1998 | Fuisz | 424/488 |
| 5,827,563 | A | 10/1998 | Battist et al. | 426/572 |
| 5,851,552 | A | 12/1998 | Myers et al. | 424/488 |
| 5,851,553 | A | 12/1998 | Myers et al. | 424/488 |
| 5,853,762 | A | 12/1998 | Myers et al. | 424/488 |
| 5,866,163 | A | 2/1999 | Myers et al. | 424/469 |
| 5,866,188 | A | 2/1999 | Battist et al. | 426/549 |
| 5,871,781 | A | 2/1999 | Myers et al. | 425/9 |
| 5,874,110 | A | 2/1999 | Blake et al. | 424/488 |
| 5,895,664 | A | 4/1999 | Cherukuri et al. | 424/464 |
| 5,935,600 | A | 8/1999 | Cherukuri et al. | 424/464 |
| 5,965,162 | A | 10/1999 | Fuisz et al. | 424/464 |
| 5,965,164 | A | 10/1999 | Fuisz et al. | 424/489 |
| 6,086,430 | A | 7/2000 | Fuisz et al. | 264/5 |
| 6,129,926 | A | 10/2000 | Fuisz | 424/401 |
| 6,171,607 | B1 | 1/2001 | Fuisz et al. | 424/405 |
| 6,337,082 | B1 | 1/2002 | Fuisz et al. | 424/439 |
| 6,669,839 | B2 | 12/2003 | Tipton et al. | 210/85 |
| 6,834,654 | B2 | 12/2004 | Williams | 131/352 |
| 6,845,777 | B2 | 1/2005 | Pera | 131/270 |
| 2001/0000386 | A1 | 4/2001 | Peele | |
| 2005/0244521 | A1 | 11/2005 | Strickland | |
| 2006/0257463 | A1 | 11/2006 | Elsohly et al. | 424/449 |
| 2007/0149408 | A1 | 6/2007 | Thomas et al. | |
| 2008/0029117 | A1 | 2/2008 | Mua et al. | 131/352 |
| 2008/0185074 | A1 | 8/2008 | Chen | |
| 2008/0302682 | A1 | 12/2008 | Engstrom et al. | |
| 2009/0095313 | A1 | 4/2009 | Fuisz | 131/290 |

FOREIGN PATENT DOCUMENTS

| | | | | |
|---|---|---|---|---|
| JP | 2007-514767 | A | 6/2007 | |
| WO | 2005/046363 | | 5/2005 | |
| WO | 2005/063217 | A1 | 7/2005 | |
| WO | 2006/004480 | | 1/2006 | A61K 9/70 |
| WO | 2007/138484 | | 12/2007 | A24B 15/16 |
| WO | 2009048522 | A1 | 4/2009 | |
| WO | 2009/068279 | A1 | 6/2009 | |

OTHER PUBLICATIONS

JP Office Action of Appln. No. 2012-517855 dated Jun. 2, 2014 with English translation.

Office Action of IN Application No. 517/DELNP/2012 dated May 29, 2018.

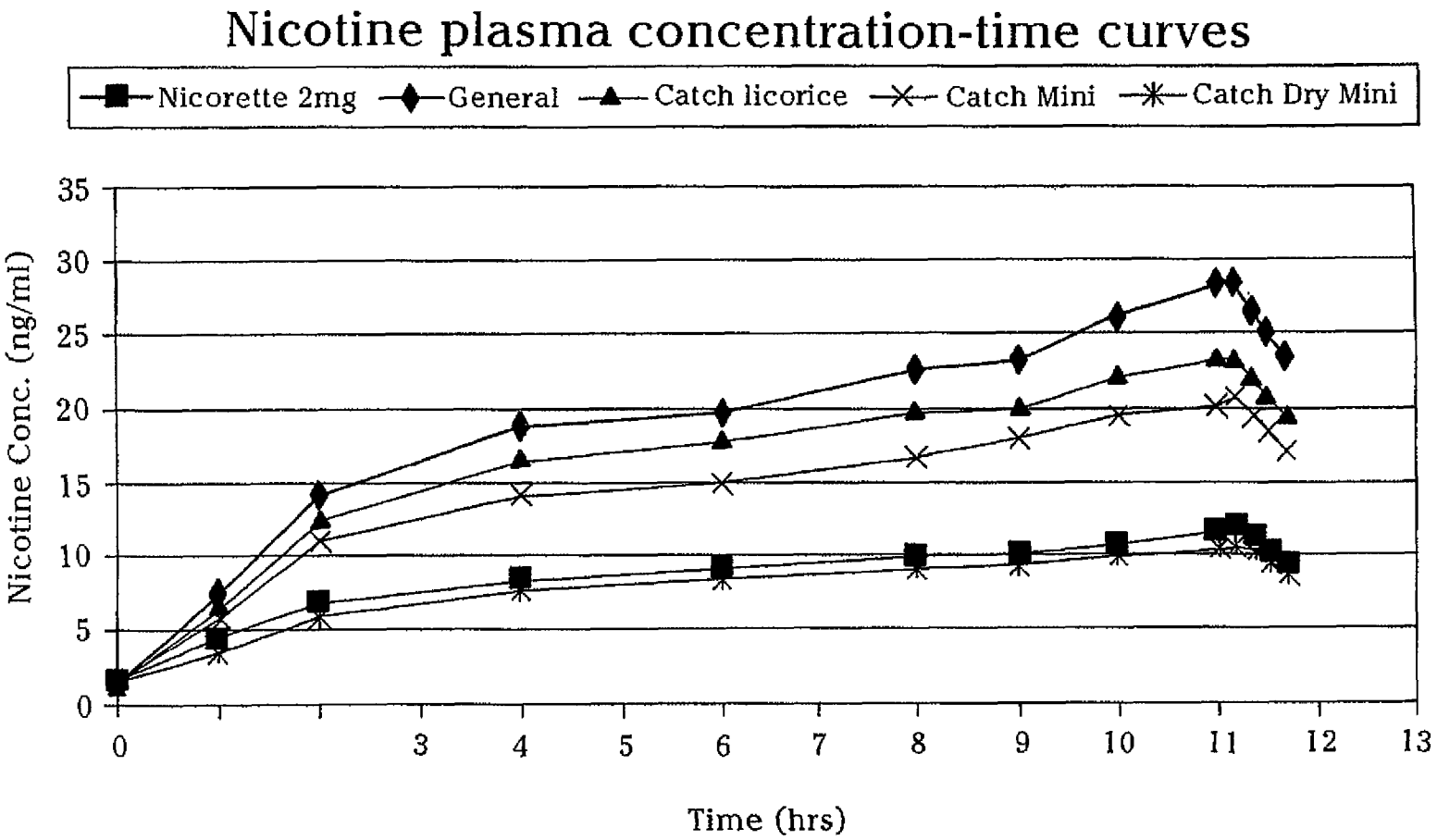
Nicotine plasma concentration-time curves
Nicorette 2mg
General
Catch licorice
Catch Mini
Catch Dry Mini
Nicotine Conc. (ng/ml)
35
30
25
20
15
10
5
0
0
3
4
5
6
7
8
9
10
11
12
13
Time (hrs)

SMOKELESS TOBACCO PRODUCT

CROSS-REFERENCE TO RELATED APPLICATION

This application is a continuation application of U.S. application Ser. No. 12/494,960 filed Jun. 30, 2009, the contents of which are incorporated herein by reference.

BACKGROUND OF THE INVENTION

The present invention relates, inter alia, to a smokeless and spitless tobacco product, a melt-spun tobacco composition, a method for manufacturing a smokeless tobacco product and a method for delivering nicotine contained in tobacco to a user. The present invention also involves a unique method of amalgamating significant amounts of tobacco with a feedstock in resulting in a dissolvable tobacco composition.

American consumption of smokeless tobacco is growing while cigarette smoking is declining. Awareness of the potential health risks of smoking, the potential risks of second hand smoke to third parties, and the increasing existence of cigarette smoking bans are all factors that are helping to shift tobacco consumption from cigarettes to smokeless tobacco. U.S. sales of moist snuff increased 10% in 2006 after several years of 6% growth while cigarette consumption declined. Another potential contributing factor to this shift is the increasingly held view in the public health community that smokeless tobacco may be much less harmful to the health of the user than is cigarette smoking. In addition smokeless tobacco does not infiltrate the air surrounding the users with tobacco smoke.

Smokers want alternatives to cigarette smoking. UST Inc., a holding company for U.S. Smokeless Tobacco Company, estimates that over half of US smokers are seeking smoking alternatives. Despite this fact, US smokers are generally reluctant to try smokeless tobacco products. Moreover, American consumers generally react poorly to traditional smokeless tobacco products when they do try such products.

Snus style smokeless tobacco is a steam cured tobacco popularized in Norway and Sweden that is either loose or contained in a pouch and is placed in the cheek. Dipping tobacco is another type of tobacco placed in the cheek. Now long cut tobacco has been put in single portion pouches in the past. Single portion pouches are considered convenient and are gaining increasing sales among smokeless tobacco users. Fine ground snuff tobacco has been known for centuries. Snuff is fine-ground tobacco intended for use by being sniffed or snorted into the nose or placed in the cheek In addition, a certain social opprobrium is associated with tobacco-induced spitting and/or the removal of tobacco from the mouth after use whether in a pouch or not.

As noted in a report by Swedish Match North Europe AB on its website at http://www.gothiatek.com/templates/start.aspx?page_id=73 entitled "Nicotine uptake from snus," (the content, including the citations therein, of which is incorporated herein in its entirety), nicotine contained in Swedish snus, has well-documented pharmacological effects on the central nervous system. Both the dose and the uptake rate are of importance for understanding the biological effects of nicotine in humans. The amount of nicotine that is absorbed during snus use (nicotine dose) can be quantified by measuring the concentration of nicotine or its metabolites in different body fluids, i.e. blood, saliva and urine. The uptake rate can be estimated by monitoring the increase of the blood nicotine concentration over time. The nicotine uptake from Swedish snus has been described in six scientific publications of different objectives and design. As noted in that report, the nicotine uptake from one pinch of snus is determined both by the amount of nicotine that is released from the pinch during snus use and by the amount of nicotine that passes the buccal mucosa and reaches the systemic circulation; almost half of the nicotine present in the pinch was extracted during snus use (37% from portion-packed snus and 49% from loose snus). By comparison of the total amount of excreted nicotine with the total amount of nicotine in the pinch per time unit, it has been concluded that only 10-20% of the nicotine originally present in the snus pinch is absorbed via the buccal mucosa and reaches the systemic circulation. The current inventor has demonstrated a superior method to deliver nicotine from tobacco using a slow dissolving extruded sheet containing tobacco (see Fuisz U.S. Patent Application Publication No. 2009/0095313 A1, the entire content of which is hereby incorporated by reference herein and, specifically, the clinical testing taught as an example therein).

Because smokeless tobacco users look to nicotine uptake as significant component to tobacco satisfaction, and it is desirable to maximize nicotine absorption from a given amount of tobacco, allowing the user to reduce the amount of tobacco used for a given level of nicotine absorption.

A pouch due to its thickness is exposed to a significant degree of saliva flow. This flow carries a percentage of nicotine that is significant down the throat and into the stomach, with the saliva and importantly is directly related to the amount of tobacco in the material. This nicotine is subject to first pass physiology as well. In addition the pouch wall also serves as an obstruction to nicotine outflow from the tobacco. Unpouched tobacco plugs and pinches are subject to the same dynamic. The tobacco sheet taught in US 20090095313 does not suffer from such a deficit; the product of the current invention, too, traverses this hazard.

It is beneficial to have a fully dissolving, spitless smokeless tobacco product which can be enjoyed by a user without the need to remove the product after use.

Various dissolving tobacco products have been taught.

Williams U.S. Pat. No. 6,669,839, issued Dec. 30, 2003, discloses a low nitrosamine tobacco tablet comprising at least 50% tobacco.

Williams U.S. Pat. No. 6,834,654, issued Dec. 28, 2004, discloses a low nitrosamine tobacco composition formed from pulverized tobacco and consisting essentially of Virginia flue cured tobacco.

Pera U.S. Pat. No. 6,845,777, issued Jan. 25, 2005, discloses a product comprised of tobacco, an antioxidant, caffeine and S-Adenosyl-Methionine in a tablet or capsule that is allowed to disintegrate in the mouth or buccal cavity.

Strickland et al WO 2005/04363 discloses various forms including wet cast thin films containing tobacco, tabs, toothpick like rods and wet cast flakes.

Wren WO 2007/138484 discloses fast dissolving film strips containing over 50% tobacco that dissolve in less than a minute and "preferably faster." Mua et al US 2008/0029117 A1 disclose examples of wet cast films containing tobacco, and aqueous mixtures that are extruded as films or sheets through a pasta maker. Engstrom WO 2006/004480 discloses certain dissolvable, multilayer tobacco matrixes and specific length to thickness ratios. See also Fuisz 20090095313 cited above.

The quick dissolving tobacco products that are disclosed in the above art are primarily wet cast thin film compositions that disintegrate rapidly in the mouth. It is highly doubtful that such fast dissolving products could deliver acceptable tobacco satisfaction, including sufficient nicotine absorption. They also suffer from a surface area which is so short lived that it cannot fulfill its role. Instead, the matrix will fully dissolve before acceptable nicotine is absorbed by the oral mucosa from the tobacco, and the tobacco from the dissolved matrix will be swallowed. Undoubtedly, this is part of the reason why none of these products have been sold commercially. The slower dissolving tobacco products disclosed in the art cited above (e.g. Williams) are subject to substantial salivary flow and hence are inefficient vehicles for nicotine delivery. This, together with taste and other consumer concerns has presumably led to the negligible sales in the United States of the Stonewall® and Arriva® dissolvable tobacco tablets.

In a substantial advance from the prior art, Fuisz demonstrates superior nicotine absorption through the use of a slow dissolving tobacco sheet in US 2009/0095313.

It is well understood that tobacco users are sophisticated users of nicotine, and that tobacco users may essentially titrate nicotine levels through their use of tobacco products, including cigarettes and smokeless tobacco products. Like the general populations however tobacco users also want more convenient products that better fit the modern lifestyle. Thus, sales of easy to use portion packaged smokeless tobacco are rapidly increasing at the expense of loose packaged tobacco. Dissolvable and spitless tobacco products offer a further advance with respect to convenience. However, none of the forms of dissolvable tobacco currently taught allow the user to easily manipulate the dose of tobacco used. This is taught by the current invention, which can be seen as a chewing tobacco that is also spitless and fully dissolvable. This means that the user can control dosing not merely through dosing frequency but through the size of the "pinch" of product selected by the user.

Various pharmaceutical and food compositions made using "melt-spinning" have been taught by one of the present inventors. See the following US patents and related foreign patents of Dr. Richard Fuisz, each of which is incorporated by reference as if fully stated herein: U.S. Pat. No. 4,855,326 (Rapidly dissoluble medicinal dosage unit and method of manufacture), U.S. Pat. No. 4,873,085 (Spun fibrous cosmetic and method of use), U.S. Pat. No. 4,997,856 (Method of producing compacted dispersible systems), U.S. Pat. No. 5,011,532 (Dispersed systems and method of manufacture), U.S. Pat. No. 5,028,632 (Taste masked medicated pharmaceutical), U.S. Pat. No. 5,034,421 (Moderated spun fibrous system and method of manufacture), U.S. Pat. No. 5,096,492 (Dispersed systems and method of manufacture), U.S. Pat. No. 5,196,199 (Hydrophilic form of perfluoro compounds and method of manufacture), U.S. Pat. No. 5,236,734 (Method of preparing a proteinaceous food product containing a melt spun oleaginous matrix), U.S. Pat. No. 5,238,696 (Method of preparing a frozen comestible), U.S. Pat. No. 5,268,110 (Oil removing method), U.S. Pat. No. 5,279,849 (Dispersible polydextrose, compositions containing same and method for the preparation thereof), U.S. Pat. No. 5,286,513 (Proteinaceous food product containing a melt spun oleaginous matrix), U.S. Pat. No. 5,288,508 (Delivery systems containing elastomer solvents subjected to flash flow), U.S. Pat. No. 5,348,758 (Controlled melting point matrix formed with admixtures of a shearform matrix material and an oleaginous material), U.S. Pat. No. 5,370,881 (Water-soluble delivery systems for hydrophobic liquids), U.S. Pat. No. 5,374,447 (Method of preparing a reduced-fat meat product), U.S. Pat. No. 5,380,473 (Process for making shearform matrix), U.S. Pat. No. 5,387,431 (Saccharide-based matrix), U.S. Pat. No. 5,407,676 (Hydrophilic form of perfluoro compounds and a method of manufacture), U.S. Pat. No. 5,422,136 (Starch-based food enhancing ingredient), U.S. Pat. No. 5,427,804 (Low-fat edible proteins with maltodextrins and low-saturate oils), U.S. Pat. No. 5,427,811 (Method and apparatus for spinning thermo-flow materials), U.S. Pat. No. 5,429,836 (Saccharide-based matrix), U.S. Pat. No. 5,431,950 (Reduced-fat meat product containing a melt spun oleaginous matrix), U.S. Pat. No. 5,447,423 (Apparatus for transforming the physical structure of thermo-flow material), U.S. Pat. No. 5,456,932 (Method of converting a feedstock to a shearform product and product thereof), U.S. Pat. No. 5,472,731 (Protein based food product), U.S. Pat. No. 5,490,993 (Method of preparing a proteinaceous food product containing a melt spun matrix and product thereof), U.S. Pat. No. 5,501,858 (Rapidly dispersible compositions containing polydextrose), U.S. Pat. No. 5,503,862 (Method of subjecting a protein-containing material to flash flow processing and product thereof), U.S. Pat. No. 5,516,537 (Frozen comestibles, such as frozen desserts, are formed by combining frozen comestible ingredients with a matrix resulting from melt-spinning on oleaginous substance with a carrier material), U.S. Pat. No. 5,518,551 (Spheroidal crystal sugar and method of making), U.S. Pat. No. 5,518,730 (Biodegradable controlled release flash flow melt-spun delivery system), U.S. Pat. No. 5,567,439 (Delivery of controlled-release systems(s)), U.S. Pat. No. 5,576,042 (High intensity particulate polysaccharide based liquids), U.S. Pat. No. 5,587,172 (Process for forming quickly dispersing comestible unit and product therefrom), U.S. Pat. No. 5,593,502 (Method of making crystalline sugar and products resulting therefrom), U.S. Pat. No. 5,597,416 (Method of making crystalline sugar and products resulting therefrom), U.S. Pat. No. 5,597,608 (Saccharide-based matrix incorporating maltodextrin and process for making), U.S. Pat. No. 5,601,076 (Spheroidal crystal sugar and method of making), U.S. Pat. No. 5,622,717 (Ulcer prevention method using a melt-spun hydrogel), U.S. Pat. No. 5,622,719 (Process and apparatus for making rapidly dissolving dosage units and product therefrom), U.S. Pat. No. 5,624,684 (Enzyme systems), U.S. Pat. No. 5,651,987 (Ulcer prevention and treatment composition), U.S. Pat. No. 5,654,003 (Process and apparatus for making tablets and tablets made therefrom), U.S. Pat. No. 5,709,876 (Saccharide-based matrix), U.S. Pat. No. 5,728,397 (Polydextrose product and process), U.S. Pat. No. 5,733,577 (Delivery of controlled-release system), U.S. Pat. No. 5,811,123 (Method of treating mucosal tissue), U.S. Pat. No. 5,827,563 (Spheroidal crystal sugar), U.S. Pat. No. 5,851,552 (Delivery of controlled-release system), U.S. Pat. No. 5,851,553 (Process and apparatus for making rapidly dissolving dosage units and product therefrom), U.S. Pat. No. 5,853,762 (Delivery of controlled-release system), U.S. Pat. No. 5,866,163 (Process and apparatus for making rapidly dissolving dosage units and product therefrom), U.S. Pat. No. 5,866,188 (Comestible composition having spheroidal crystal sugar), U.S. Pat. No. 5,871,781 (Apparatus for making rapidly-dissolving dosage units), U.S. Pat. No. 5,874,110 (Entrapping additives in carbohydrate bodies), U.S. Pat. No. 5,895,664 (Process for forming quickly dispersing comestible unit and product therefrom), U.S. Pat. No. 5,935,600 (Process for forming chewable quickly dispersing comestible unit and product therefrom), U.S. Pat. No. 5,965,162 (Process for forming chewable quickly dispersing multi-vitamin preparation and product therefrom), U.S. Pat. No. 5,965,164 (Recipient-dosage delivery system), U.S. Pat. No. 6,020,002 (Delivery of controlled-release system(s)), U.S. Pat. No.

6,083,430 (Method of preparing a dosage unit by direct tableting and product therefrom), U.S. Pat. No. 6,129,926 (Flash flow processing of thermoplastic polymers and products made therefrom), U.S. Pat. No. 6,171,607 (Process and apparatus for producing shearform matrix material), U.S. Pat. No. 6,277,406 (Easily processed tablet compositions), and U.S. Pat. No. 6,337,082 (Saccharide-based matrix).

None of the preceding or any other "melt-spinning" patents teach or otherwise suggest the use of a "melt-spinning" process to make smokeless tobacco compositions.

Thus, applicant has found that it is desirable to provide for a tobacco composition made by "melt-spinning."

BRIEF SUMMARY OF THE INVENTION

The present invention relates an edible, dissolvable smokeless tobacco product made using a "melt spinning" process.

The present invention also relates melt spun tobacco composition, e.g., in flake or particle form, for oral use in a mammal made by melt spinning comprising tobacco and/or a tobacco extract and at least one material which is solid at room temperature, which melts at or below 500° F., and carries from 1% to 70% of tobacco when processed through melt spinning, and solidifies again in less than 5 seconds after melt spinning.

The present invention also relates to a smokeless tobacco product comprising of flakes, floss and other shapes made by "melt spinning" a composition comprising at least one feedstock and tobacco, the melt-spun flakes, floss or other shapes comprising a matrix compared of at least one feedstock and tobacco amalgamated thereto, the matrix being soluble in a user's mouth and resulting in sustained release of nicotine to the user.

The present invention also relates to a smokeless tobacco product comprising a composition made by "melt spinning" comprising at least one feedstock and tobacco in a form that may be placed in a buccal cavity, sublingually or on a palate of a user and having an average dissolution time of 2 to 120 minutes, preferably 5 to 80.

The present invention also relates to a method for delivering super bioavailable nicotine from a tobacco product to a user, comprising a composition made by "melt spinning" consisting of at least feedstock and tobacco; and placing the flake, floss or other shaped matrix in the buccal cavity of, or on the palate of or sublingually in the user.

BRIEF DESCRIPTION OF THE DRAWINGS

FIG. 1 is a graph showing nicotine plasma concentration vs. time curves obtained on consumption of four different snus brands and a 2 mg nicotine chewing gum according to the Gothiatek cited Lunell study.

DETAILED DESCRIPTION OF THE INVENTION

In one aspect of the present invention, the invention relates to an edible, dissolvable composition made by "melt spinning" comprising at least one feedstock and tobacco.

In the context of the present invention "melt-spinning" means subjecting feedstock and tobacco (together with any other excipients) (collectively, the blended composition) to the combination of temperature, thermal gradients, mechanical forces, flow, and flow rates during processing which is comparable to that applied to the feedstock during operation of a machine for producing cotton candy. This is in contrast to the use of the term melt-spinning or spray drying in the polymer-processing art. Spray drying uses a liquid material. Tobacco is not readily soluble. Conventional "spray drying" used to describe processes for spraying materials which are held under liquid or melted conditions for comparatively long periods of time before being sprayed under direct pressure through an orifice and then allowed to dry. It is a methodology which requires a liquid state.

The present invention is a unique method of producing a tobacco composition that includes subjecting an edible feedstock together with tobacco (with any other excipients) to conditions of temperature and shear sufficient to induce extremely short duration flow that alters the structure of the feedstock resulting in a new matrix.

Extreme short duration flow is referred to in the present process as a phenomenon which occurs when the compositional blend is subjected to conditions of temperature and shear sufficient to provide internal flow of an extremely short duration of seconds to subseconds. This condition produces a transformation of structure without degradation of the material. Internal flow occurs when the infrastructure of the feedstock material breaks down sufficiently to permit movement of the material at what is a molecular level. At a molecular level, internal flow contemplates the movement of molecules relative to each other.

Furthermore the melt spun process described here is a unique method of amalgamating a solid tobacco with a feedstock. This is a very novel way of using melt spinning to modulate the marriage of two microscopic domains which are of completely different rheological properties and amalgamating to create a new format that has a very large surface area (e.g. flakes). While this form is an end product it can also serve as a downstream format for further processing methods.

In the present invention, the compositional blend is subjected to flash flow sufficiently to deform and pass through an opening under minimum amount of force. The force used in the present preferred embodiments of the invention is centripetal force provided by a spinning head from which the deformed compositional blend is thrown at high speed and almost instantaneously converted to a heterogeneous solid by the ambient airstream. No external force is imposed on the flowable compositional blend after it is flung out of the spinning head. The compositional blend instantaneously reforms as a solid having altered physical and/or chemical structure. The altered structure results from the forces acting on the material as it exits the head and is hurled outwardly during the very brief period during which it experiences flow. The centripetal forces are a function of spinner head rotational speed (rpm) and spinner head radius. As the material exits the head, there is interplay with viscosity and tobacco size compared to aperture size and design during the extremely brief duration of flow.

The extremely brief duration flow phenomena—in which the meted material returns to solid form after exit from the spinner head—occurs in not more than two seconds, preferably on the order of tenth of seconds, e.g., not more than about 0.5 seconds, and most preferably on the order of milliseconds, and certainly not more than 5 seconds. This unique phenomenon can be produced by relatively high speed distribution of the blended material to an environment of elevated temperature under a natural force, such as centripetal force, caused by high speed rotation of an aperture containing continuous-wall spinning head. As noted above, one example of a mechanism for producing such a combination is a cotton candy making machine. Variations of such an apparatus are contemplated for use in the present invention. The important aspect is that the extremely brief duration flow phenomena be induced in a blended composition for rapid transition to new physical format having an altered structure from that of the disparate rheological properties of the feedstock.

The melt spinning machine may be, but is not limited to the type of machine shown and described in U.S. Pat. No. 4,872,821, the entire content of which is incorporated by reference herein. Other melt spinning machines can be used. As noted above, the machine should allow the feedstock material carrying the tobacco to be solid until it is heated by the heating element and to quickly solidify after being ejected from the apertures. The heating element may be, without limitation a band, ribbon or any other form of heating element.

As discussed above, after exposure to "melt spinning", the flow thereby induced will alter the physical shape of the feedstock blended composition, such blended composition taking on a different physical shape after ejection from the spinner and now unifies a non meltable tobacco and a meltable feedstock into a new format. Such format may include, without limitation, a flake, filament, ribbon, spicule, floss, fiber, particle, sphere or mixture thereof. This material can made into a formed tablet. The shape of the new format is a function of the compositional blend as well as the process parameters including temperature, rpm, feed rate, as well as the size and design of the spinning head including its apertures.

The rpm of the spinning head is of particular importance. Off the shelf cotton candy spinners are typically designed to operate at one rotational speed. This rotational speed is selected based on the melt and flow properties of common sugar—which is the base "feedstock" for cotton candy. To make cotton candy, it is desirable to efficiently melt sugar, creating nicely elongated floss. However, higher speeds may not be desired due to energy consumption and more practically, balance issues. Operating at high rotational speeds outside of feed and output equilibrium may create dangerous vibrations—akin to an out of balance washing machine. It is desirable to modify the spinning head to allow for control over rotational speed so that the equilibrium may be achieved for the tobacco composition of the present invention.

Together with the rpm of the spinning head, the radius of spinner head is also important. *Ceteris paribus*, a greater radius will increase the centripetal force on the feedstock. In Newtonian physics, centripetal force=mass*((velocity*velocity)/radius). In this equation, the effects of feedstock mass, feedstock flow rate, rpm and spinning head diameter can be seen. Of course, other factors not captured by this basic equation, such as the rheology of the feedstock at various temperatures, the size and shape of the aperture and the temperature of the spinning head and ambient temperature are all at play.

The physically altered material may then be further manipulated using known processes. For example, flakes may be ground into smaller flakes. Tobacco floss may be compressed into a tablet (see e.g. U.S. Pat. No. 6,277,406 (Easily processed tablet compositions) (cited above).

Feedstock materials may include any material that is a solid at room temperature and will melt at less than 500° F. and is then capable of returning to a solid form almost instantly (i.e., in less than 5 seconds) when it is in contact with normal ambient air.

The feedstock may comprise but not be limited to at least one material selected from the group consisting of cellulose ethers, polyethylene oxide, polymethacrylates, poloxamers, extrudable carbohydrates, polyethylene glycols, PVP, poly vinyl alcohol, acrylates, ethyl cellulose, cellulose acetate butyrate, poly(ethylene-co-vinyl acetate), poly vinyl acetate, poly(methylvinyl ether/maleic anhydride) co-polymer and hydroxypropyl methylcellulose (HPMC), provided that the feedstock must be meltable at less than 500 F. Pullulan does not melt at less than 500° F. and degrades at 250° C., and therefore, is not a suitable feedstock material for the present invention. Similarly, certain HPMC grades are not meltable at less than 500 F and are hence not suitable for use as a feedstock.

In one embodiment of the invention, a cellulose ether such as hydroxypropyl cellulose (HPC) is preferred. Examples of commercially available HPC that can be used include KLUCEL® EF, ELF and LF hydroxypropylcellulose (HPC) sold by Hercules Incorporated, Aqualon Division, of Wilmington, Del. (referred to hereinafter, respectively, as HPCEF, HPCELF and HPCLF).

Various PEO grades may be used, including without limitation WSR N10.

The feedstock material may compromise a blend of different materials.

In this specification, percentages are given in weight percent unless otherwise indicated.

Feedstock materials are preferably currently acceptable for food use, although it is expressly contemplated that certain materials not currently accepted will become acceptable in the future. It is also preferable that the feedstock is water soluble. However, insoluble materials may be used alone or in conjunction with soluble material to extend the dissolution time. Waxes may be used to extend dissolution time in the mouth and to modify consistency.

It is noted that the pharmaceutical spun melt art is largely directed at the use of table sugars as a feedstock material or of a nearly pure pharmaceutical agent. Basic sugars are not desirable for use with the present invention, because a matrix made therefrom will tend dissolve too rapidly and many are extremely hygroscopic. Of course, such rapid dissolution was considered a desirable attribute in pharmaceutical delivery.

Surface and interfacial tension of the product can be modified with lypophylic agents such as fats etc. (0.1 to 5%) for the purpose of making the finished flake or other format attract to itself and not to the teeth. Plasticizers may also increase self-adherence. Those skilled in the art will understand that one is balancing the surface and interfacial tension with the wettability of the materials. It should be noted however that even without a lypophylic agent, many embodiments of the present invention will tend to self-adhere because of the particulate nature of this product and the high % of tobacco which can promote self adhesion and prevent migration of numerous small particles to other parts of the mouth and teeth.

The melt spun composition comprises at least one feedstock in an amount of 30 wt % or more of the whole composition.

It is desirable that the resulting spun melt composition dissolves in the mouth of a mammal, especially a human, at a time between 2-120 minutes, preferably 5-80 minutes.

The tobacco can have a thickness of 0.1 micron or more, up to 500 micron particles microns so that it has an ability to be carried by the meltable material. Tobacco does not melt; accordingly, tobacco particles cannot pass through a spinning head aperture that is smaller than the tobacco particle size itself. Of course, wholesale increase of the spinning head aperture size will render the melt spun process akin to an unprocessed seed scatter implement and too small or closed apertures to that of a centrifuge. Those skilled in the art will come to understand the relationship between tobacco particle size and rheology and the size of the spinning head aperture through the examples taught in the present invention.

It is preferable to use low nitrosamine tobacco. Tobacco blends may be used. Thus, the tobacco is preferably snuff tobacco preferably having a size distribution between 0.1 and 300 microns (inclusive). Brutons and Packard's Club snuff are non limitative examples of the type of tobacco and particle size that can be used. Ground SNUS tobacco, available from American Smokeless in South Boston, Va., may also be used as well as virtually any type of tobacco that can be ground and or sieved to an appropriate size. The tobacco can comprise a tobacco extract in whole or in part.

The resulting composition in certain embodiments may be chewable. Chewability is a function of the materials used in the composition, as well as the thickness of the product. For example and without limitation, flakes with a thickness of over 10 mils with a 40-60% HPC ELF can be made to be quite chewable.

It is preferable that the composition will comprise a fairly high level of tobacco. This is due, among other things, to the fact that tobacco itself may be less expensive than the feedstock material. Moreover, many jurisdictions may tax the product by total mass, meaning that feedstock (and other excipient mass) may be subject—under an erroneous tax theory to be sure—to "tobacco" taxation. Preferably, the composition will comprise 15-70%, preferably 20-60%, tobacco. If tobacco extracts are used, the amount of tobacco extract can be lower, e.g., 1% or more.

The composition can also include a mucosal absorbing enhancer, i.e., a substance that enhances absorption of tobacco nicotine through buccal and gingival mucosa and epithelium (otherwise known (see U.S. Patent Application Publication No. 2006/0257463) as a "penetration enhancer" or "permeability enhancer"). The mucosal absorbing enhancer may include but is not limited to polyethylene glycol (PEG), diethylene glycol monoethyl ether (Transcutol), 23-lauryl ether, aprotinin, azone, benzalkomin chloride, cetylperidium chloride, cetylmethylammonium bromide, dextran sulfate, lauric acid, lauric acid/propylene glycol, lysophosphatilcholine, menthol, methoxysalicylate, oleic acid, phosphaidylcholine, polyoxyethylene, polysorbate 80, sodium EDTA, sodium glycholated, sodium glycodeoxycholate, sodium lauryl sulfate, sodium salicylate, sodium taurocholate, sodium taurodeoxycholate, sulfoxides, and various alkyl glycosides or, as described in U.S. Patent Application Publication No. 2006/0257463, bile salts, such as sodium deoxycholate, sodium glycodeoxycholate, sodium taurocholate and sodium glycocholate, surfactants such as sodium lauryl sulfate, polysorbate 80, laureth-9, benzalkonium chloride, cetylpyridinium chloride and polyoxyethylene monoalkyl ethers such as the BRIJ® and MYRJ® series, benzoic acids, such as sodium salicylate and methoxy salicylate, fatty acids, such as lauric acid, oleic acid, undecanoic acid and methyl oleate, fatty alcohols, such as octanol and nonanol, laurocapram, the polyols, propylene glycol and glycerin, cyclodextrins, the sulfoxides, such as dimethyl sulfoxide and dodecyl methyl sulfoxide, the terpenes, such as menthol, thymol and limonene, urea, chitosan and other natural and synthetic polymers. Preferably, the mucosal absorbing enhancer is a polyol, e.g., polyethylene glycol (PEG), glycerin, maltitol, sorbitol etc. or diethylene glycol monoethyl ether (Transcutol).

In addition one can add 0.1 to 10%, preferably 0.1 to 5%, more preferably 0.1 to 3%, PEG to this mix to aid mucous layer penetration.

To improve the absorption of nicotine by the user, it is preferred that composition has a pH of 6 to 9.5, preferably 7.5 to 9. Buffering agents may be used to control pH, including without limitation, sodium bicarbonate, potassium bicarbonate, sodium carbonate, potassium carbonate, calcium carbonate, calcium silicate, dipotassium phosphate, potassium citrate, sodium phosphate and any other such buffer system. The buffer system may be designed to dynamically control the pH of the product taking into consideration the effect of saliva during use, i.e., a dynamic buffer system. Examples of buffer systems to obtain the preferred pH include dibasic sodium phosphate and monobasic sodium phosphate. Both are FDA accepted buffer materials used and listed in the inactive ingredients list.

Tobacco Specific Nitrosamines (TSNAs) are considered by many to be a negative to tobacco users. Accordingly, in this view, the control and minimization of TSNA levels in the final product is desirable. This is achieved by starting with a tobacco that is low in TSNAs. A low moisture content in the final product may also mitigate growth of TSNAs. Some believe that SNUS is refrigerated in part to retard such growth TSNAs are thought to be created, among other ways, by exposure to heat. In addition heat may also be desirable to pasteurize the tobacco product. Thus, it is desirable to manage heat exposure as a process parameter. It is preferred that the final melt spun composition has a tobacco specific nitrosamine (TSNA) content less than 3 ppm, preferably below 2 ppm and more preferably below 1 ppm. In addition to the parameters discussed above, his can be achieved in the manner set forth hereinafter. The total amount of TSNAs is the product of concentration and mass. Since the product of the present invention can use a reduced amount of tobacco due to nicotine super bioavailability and the amalgamating of an edible material, in the place of additional tobacco, in a high percentage compared to traditional smokeless tobacco products, it can be seen that the product of the present invention can have a reduced total TSNA content relative to traditional smokeless tobacco products.

The melt spun composition can also, optionally, include a sweetener, including without limitation any sugar, sucralose or other artificial sweetener, and/or a flavoring, without limitation e.g., peppermint, cherry, bourbon, rum, smokey rose, sweet brown & spicy, wintergreen, cool mint, bergamot, citramint, and licorice. Suitable flavoring additives are commercially available from Tobacco Technology, Inc. of Eldersburg, Md.

The melt spun composition can also include a plasticizer. The plasticizer may be present in an amount up to 15% of the final composition. The plasticizer can be, without limitation, at least one of polyethylene oxide, polypropylene glycol, polyethylene glycol, glycerin, edible polyols, glycerol, polyols, maltitol, isomalt, and reduced sugars.

It may be desirable for the product to have a look and feel that is similar to existing smokeless tobacco products, like moist snuff and SNUS, to provide a dissolvable, spitless alternative product. Such products feel "wet" because they are: end products can have moisture levels of up to and even exceed 50% by mass. It is not desirable to have substantial moisture levels in the melt spun product because high moisture content can create physical instability issues. Therefore, it may be desirable to create a "wet" appearance and feel through the use of a high percentage of plasticizer, e.g. 12% propylene glycol.

The smokeless tobacco product preferably includes, after manufacture, less than 20%, preferably less than 10 wt %, more preferably less than 7 wt %, and most preferably less than 5 wt % water.

Coloring agents can optionally be added. The use of titanium dioxide up to 12% by mass results in a white or lightly colored product. A coloring agent such as titanium dioxide can be used combination with a lightly colored tobacco, such as Bruton or F & T snuff as it is lighter in color resulting in a lighter colored product. Other edible pigments may be used, including without limitation, Colorcon Red #40.

In addition, up to 10%, preferably 3-5% of an acceptable silicate (e.g. calcium silicate) can be used especially if the tobacco has been steam cured and has a significant moisture content to promote flowability of the compositional blend for uniform processing. Flow is the ability of a material to not reach a high angle of repose before moving on. It is a minimal issue here because a downfeed may be employed with the spinner.

In addition it is important to have the potential to use a stainless or other such material which is fashioned as a "cone". This cone is placed centrally in the spinner head and transfers vertical fall into a horizontal vector. This accomplishes two major things here: it minimizes time in the spinner head environment to prevent heat buildup of the material being processed and it also aids in the establishment of a dynamic equilibrium between the egress of processed material and the ingress of material to be processed.

Flowability of the compositional dry blend may also be engendered through proper mixing techniques. For example, the use of a high shear mixer may be necessary to prevent the formation of "fish eyes" or agglomerations from flavor or residual moisture in ingredients. High shear mixing is essential when any product with moisture (usually residual to prior ingredient process) is added to the composition mix. One fish eyes or agglomerations are formed and can create blockages during spinning (i.e. fail to leave the spinner); hence high shear mixing must be employed from the beginning.

A standard dose or pinch of the melt spun composition preferably has an average (user dependent) dissolution time of 2 to 120 minutes and preferably 5 to 80 minutes depending on the size of pinch and the thickness of the flake like particle and factors like saliva and placement location. The ability of the user to control the size of the dose (which will also effect dissolution time) is an express object of the present invention.

Control over dose is also critical to allow for desired plasma concentrations of nicotine in the user. A preferred aspect of the present invention to provide for a level of nicotine delivery (measured as a plasma concentration) that is equal or greater to the nicotine delivery of most robust SNUS pouches shown in FIG. 1 hereof.

Additionally a saliva enhancer might be added, such as citric acid, in amounts from 0.1 to 4% if one is desirous of increasing saliva flow. Many materials can be used for this purpose but presumably caution must be used if the product is to remain spitless.

The smokeless tobacco product of the present invention preferably has a content uniformity in the range of ±10%, more preferably ±5%. The composition can be packaged in a number of different ways, some of which will be apparent to those skilled in the art.

In yet another embodiment, the product can be packaged in a typical smokeless tobacco container. The product may be used in a package that disperses pre-determined amounts of material. It is also possible to use the present invention in conjunction with an insoluble porous pouch as is typically used in portion packages of smokeless tobacco products. The product may also be packaged in a soluble pouch with holes to allow for earlier disintegration of the product itself. Those schooled in the art will understand that a band cast poly vinyl alcohol film would be particularly suitable for this purposes, but such soluble pouch can be made with various systems using wet casting, band casting or extrusion art.

As a method to prevent or reduce tacking or stickiness of the spun melt format, particles of edible material may be sprinkled or dusted over the flakes. Such dusting may be done during manufacturing of the flakestock or during the final packaging. Fine tobacco powder may also be used. This performs the desired anti-tacking function and also provides a tobacco aroma when the container is opened that may be pleasing to the user. Any edible non hygroscopic powder material may be used.

Enzymatically mediated materials may be used in the composition such as CMC enzyme to aid in the breakdown of the composition in the wet environment of the mouth. Another example is the addition of amylase to the composition (which is also naturally occurring in saliva) to aid in the dissolution of starch content.

Smokeless tobacco users frequently describe a tingling in the gum associated with nicotine absorption across the oral mucosa. It may be desirable in certain embodiments of the product to enhance the perception of tingling by using certain topically effective agents. For example menthol may provide a topical sensation akin to that associated with nicotine absorption. There are other agents that can cause this, e.g., peppermint, spearmint, wintergreen and many other agents too numerous to mention but known to one skilled in this art.

Another aspect of the invention is a method for delivering nicotine from a tobacco product to a user by providing a dissolvable composition comprising at least one meltable feedstock and tobacco, and placing the melt spun composition in the buccal cavity of, on the palate of or sublingually or next to the internal cheek or the internal lip of the user. The present invention enables the nicotine to be delivered to the user in a super bioavailable form because the spinning process results in a very large surface area. By providing a product that can be used directly contacting the mucosa allows the product to efficiently transfer its nicotine to the oral mucosa. In the present invention, the spun melt can be tucked between the cheek and gingival epithelial cells in a manner such that it has a large surface area in contact with the mucosa on the interior of the mouth. If using pure tobacco or snuff amalgamated to a food product, the relative amount of tobacco itself, in the product, is much lower than in other smokeless forms. In addition, and very importantly, the surface area of the tiny particulate snuff is huge compared to the surface area of the whole tobacco product used in competing smokeless tobacco products. The net result is a far higher ratio of absorption of nicotine through the mucosa. This occurs whenever the surface area is expanded. Reduction of salivary flow by using a composition that flattens against the mucosa is also important. Maximizing the surface area of tobacco with the oral mucosa is a critical aspect of this invention. It accomplished through two complementary aspects of the invention. First, the shape of the composition itself maximizes contact area. Second, the use of finely ground tobacco particles also serves to maximize surface area. At the same time, salivary pass through is minimized. This optimization leads to greater nicotine absorption than is seen in traditional tobacco products.

The use of the tobacco amalgamated to the edible, melted product results in less tobacco being used than with a conventional smokeless tobacco product.

Physical stability of the product is critical for use of the product. The product should be reasonably pliable for use by the consumer and not excessively tacky. Moreover, the product should be physically stable without the use of expensive barrier packaging like foils, or Aclar®. The product of the present invention can be stored at room temperature in conventional plastic "pucks" commonly used for smokeless tobacco products in the United States for a period of time, e.g., sixty days with no demonstrable increase in tackiness.

Use of tobacco extract in the spinnable mixture and the possible combination of that extract with an ion exchange resin to mediate taste and throat burning is another variant of this invention.

While ostensibly unknown in the tobacco formulation and composition art, it may be desirable to include an agent in the composition that retards microbial or fungal growth. Such agents may include, without limitation, benzoate, EDTA etc.

The following are nonlimitative examples of the present invention. The spinning machines used for the examples below include Econofloss ribbon machine with a 5 inch diameter spinning head by Gold Medal and the Breeze Cotton Candy Machine with a 5.5 inch diameter spinning head also made by Gold Medal. In some examples, the apertures of a stock Breeze spinner head are modified to a width of 30 mils. A fourteen cup Cuisinart was used as a mixer. All temperatures were measured using an IR Thermometer 12:1 Sper Scientific. All rpm measurements were provided by the manufacturer and confirmed using a Monarch Instrument Nova Strobe Bax. All pH measurements where made using an Oakton pH5 Acorn Series, by dissolving the composition into water using a ratio of one part composition to two parts water.

Example A

| Ingredient | Percentage of initial composition fed into spinner | Supplier |
|---|---|---|
| HPC ELF | 50% | Aqualon/Hercules |
| Tobacco - ground SNUS | 30% | American Smokeless |
| Calcium Carbonate | 7% | Spectrum Chemical |
| Calcium Silicate | 3% | Akrochem |
| Propylene Glycol | 3% | Spectrum Chemical |
| Polyethylene Glycol 1000 | 2% | Spectrum Chemical |
| Sucralose | 1% | Tate & Lyle |
| Coffee Flavor | 2% | Tobacco Technology, Eldersburg, Maryland |
| Titanium Dioxide | 2% | Spectrum Chemical |

Two pounds of the composition above where mixed using Cuisinart. The material was fed by use of a cone into a Breeze Cotton Candy Machine (using the stock spinner head). The rpm of the Breeze machine was 3450 rpm; the temperature was measured at 210 F.

The process resulted in large supple, flakes. The large flakes where made smaller using the chopping function of the same Cuisinart machine. The PH of the flakes was measured and determined to be 7.8.

Example B

Two additional pounds of the blend of Example B were made using the same mixer. This material was spun in the Breeze machine at higher temperatures; 235° F. and 300° F. Some burning was detected particularly at 300° F.; it was observed that this burning could be ameliorated with changes to the spinning equipment (see examples below).

Example C

| Ingredient | Percentage of initial composition fed into spinner | Supplier |
|---|---|---|
| HPC ELF | 50% | Aqualon/Hercules |
| Tobacco - | 44% | Bruton Dry Snuff |
| Propylene Glycol | 3% | Spectrum Chemical |
| Sucralose | 1% | Tate & Lyle |
| Cool Mint | 2% | Tobacco Technology, Eldersburg, Maryland |

Two pounds of the above composition were mixed using the Cuisinart. The resulting blend was placed using a cone into the Breeze machine using the stock spinner head. The breeze machine was running at 3450 rpm and was set at 30% power and the temperature was measured at 210° F.

The process resulted in flakes. The pH of the resulting flakes was measured at 6.34.

It was desired to increase the pH; therefore, Calcium Silicate was added as 4% of the composition (proportionally decreasing the percentage of the other constituents). This new blend was made using the procedure above. The pH of the resulting flakes was measured as 7.8.

Example D

| Ingredient | Percentage of initial composition fed into spinner | Supplier |
|---|---|---|
| HPC ELF | 55.5% | Aqualon/Hercules |
| Tobacco - | 30% | Bruton Dry Snuff |
| Propylene Glycol | 4% | Spectrum Chemical |
| Sucralose | .5% | Tate & Lyle |
| Flavor blend: 50:50 Air Cured Tobacco and Cool Mint | 2% | Tobacco Technology, Eldersburg, Maryland |
| Calcium Silicate | 4% | Akrochem |
| Titanium Dioxide | 2% | Spectrum Chemical |
| Polyethylene Glycol 1000 | 2% | Dow Chemical |

Two pounds of the above composition were mixed using the Cuisinart. The resulting blend was placed using a cone into the Breeze machine using the stock spinner head. The breeze machine was running at 3450 rpm and was set at 25% power and the temperature was measured at 224° F.

The process resulted in flakes. The pH of the resulting flakes was measured at 8.03.

Example E

| Ingredient | Percentage of initial composition fed into spinner | Supplier |
|---|---|---|
| Polyethylene Oxide N-80 | 52.7% | Dow Chemical |
| Tobacco - | 35% | Bruton Dry Snuff |
| Propylene Glycol | 4% | Spectrum Chemical |

-continued

| Ingredient | Percentage of initial composition fed into spinner | Supplier |
|---|---|---|
| Sucralose | .3% | Tate & Lyle |
| Flavor blend: 50:50 Air Cured Tobacco and Cool Mint | 2% | Tobacco Technology, Eldersburg, Maryland |
| Calcium Silicate | 4% | Akrochem |
| Titanium Dioxide | 2% | Spectrum Chemical |

Two pounds of the above composition were mixed using the Cuisinart. The resulting blend was placed using a cone into the Breeze machine (using the stock spinner head). The breeze machine was running at 3450 rpm; power was increased until the head temperature reached 370° F. and still no flakes or other formats were produced from the spinning head. This was attributed to the melt flow dynamics of the N 80 grade; it is believed that higher RPM's and a larger diameter spinning head might allow this formula to process. As is seen below, N80 (and N10) processed very well when the aperture size on the breeze spinning head was increased from 6 mil to 30 mil.

Example F

| Ingredient | Percentage of initial composition fed into spinner | Supplier |
|---|---|---|
| HPC ELF | 52.7% | Aqualon Hercules |
| Tobacco - | 35% | Bruton Dry Snuff |
| Propylene Glycol | 4% | Spectrum Chemical |
| Sucralose | .3% | Tate & Lyle |
| Flavor blend: 50:50 Air Cured Tobacco and Cool Mint | 2% | Tobacco Technology, Eldersburg, Maryland |
| Calcium Silicate | 4% | Akrochem |
| Titanium Dioxide | 2% | Spectrum Chemical |

Two pounds of the above composition were mixed using the Cuisinart. The resulting blend was placed using a cone into the Breeze machine (using the stock spinner head). The breeze machine was running at 3450 rpm and the temperature was measured at 231° F.

The process resulted in flakes. The pH of the resulting flakes was measured at 8.29.

Example G

| Ingredient | Percentage of initial composition fed into spinner | Supplier |
|---|---|---|
| HPC ELF | 26.35% | Aqualon Hercules |
| Polyethylene Oxide WSR N10 | 26.35% | DOW Chemical |
| Tobacco - | 35% | Bruton Dry Snuff |
| Propylene Glycol | 4% | Spectrum Chemical |
| Sucralose | .3% | Tate & Lyle |
| Flavor blend: 3:1 Air Cured Tobacco and Cool Mint | 2% | Tobacco Technology, Eldersburg, Maryland |
| Calcium Silicate | 4% | Akrochem |
| Titanium Dioxide | 2% | Spectrum Chemical |

Two pounds of the above composition were mixed using the Cuisinart. The resulting blend was placed using a cone into the Breeze machine (using the stock spinner head). The breeze machine was running at 3450 rpm, 40% power and spinner head temperature was measured at 288° F.

The process resulted in flakes. The pH of the resulting flakes was measured at 8.72.

Example H

| Ingredient | Percentage of initial composition fed into spinner | Supplier |
|---|---|---|
| Polyethylene Oxide WSR N10 | 52.7% | Dow Chemical |
| Tobacco - | 35% | Bruton Dry Snuff |
| Propylene Glycol | 4% | Spectrum Chemical |
| Sucralose | .3% | Tate & Lyle |
| Flavor blend: 3:1 Air Cured Tobacco and Cool Mint | 2% | Tobacco Technology, Eldersburg, Maryland |
| Calcium Silicate | 4% | Akrochem |
| Titanium Dioxide | 2% | Spectrum Chemical |

Two pounds of the above composition were mixed using the Cuisinart. The resulting blend was placed using a cone into the Breeze machine (using the stock spinner head). The breeze machine was running at 3450 rpm, 35% power and spinner head temperature was measured at 278° F.

The process resulted in flakes but WSR N10 feedstock processed far better with the breeze head modified to enlarge the spinning head apertures as is seen below. The pH of the resulting flakes was measured at 8.72.

Example I

| Ingredient | Percentage of initial composition fed into spinner | Supplier |
|---|---|---|
| HPC ELF | 50% | Aqualon Hercules |
| Tobacco - | 38% | Bruton Dry Snuff |
| Propylene Glycol | 6.8% | Spectrum Chemical |
| Sucralose | .2% | Tate & Lyle |
| Flavor blend: 3:1 Air Cured Tobacco and Cool Mint | 2% | Tobacco Technology, Eldersburg, Maryland |

-continued

| Ingredient | Percentage of initial composition fed into spinner | Supplier |
|---|---|---|
| Calcium Silicate | 2% | Akrochem |
| Titanium Dioxide | 1% | Spectrum Chemical |

Two pounds of the above composition were mixed using the Cuisinart. The resulting blend was placed using a cone into the Breeze machine (using the stock spinning head). The breeze machine was running at 3450 rpm, with the spinning head temperature at 190° F.

The process resulted in flakes but demonstrated propensity to plug the spinning head. The pH of the resulting flakes was measured at 7.59.

Example J

| Ingredient | Percentage of initial composition fed into spinner | Supplier |
|---|---|---|
| HPC ELF | 50% | Aqualon Hercules |
| Tobacco - | 35% | Bruton Dry Snuff |
| Propylene Glycol | 9.7% | Spectrum Chemical |
| Sucralose | .3% | Tate & Lyle |
| Flavor blend: 3:1 Air Cured Tobacco and Cool Mint | 2% | Tobacco Technology, Eldersburg, Maryland |
| Calcium Silicate | 2% | Akrochem |
| Titanium Dioxide | 1% | Spectrum Chemical |

Two pounds of the above composition were mixed using the Cuisinart. The resulting blend was placed using a cone into the Breeze machine (using the stock spinning head). The breeze machine was running at 3450 rpm, with the spinning head temperature at 245° F.

The process resulted in flakes without the propensity to plug of the 6.8% propylene glycol formulation. The pH of the resulting flakes was measured at 7.63. The flakes had a tendency to self-adhere.

A healthy adult user placed a one gram pinch in the cheek. The product was very pleasant and lasted approximately 90 minutes.

Example K

| Ingredient | Percentage of initial composition fed into spinner | Supplier |
|---|---|---|
| HPC ELF | 50% | Aqualon Hercules |
| Tobacco - | 37% | Bruton Dry Snuff |
| Propylene Glycol | 8% | Spectrum Chemical |
| Sucralose | .2% | Tate & Lyle |
| Flavor blend: Air Cured Tobacco | 1.7% air cured | Tobacco Technology, Eldersburg, Maryland |

-continued

| Ingredient | Percentage of initial composition fed into spinner | Supplier |
|---|---|---|
| and Cool Mint | .3% cool mint | |
| Calcium Silicate | 2% | Akrochem |
| Titanium Dioxide | .8% | Spectrum Chemical |

Two pounds of the above composition were mixed using the Cuisinart. The resulting blend was placed using a cone into the Breeze machine (using the stock spinning head). The breeze machine was running at 3450 rpm, with the spinning head temperature at 200° F.

The process resulted in "moist" flakes with less propensity to self-adhere than the flakes of example J. The pH of the resulting flakes was measured at 7.64.

Example L

| Ingredient | Percentage of initial composition fed into spinner | Supplier |
|---|---|---|
| HPC ELF | 50% | Aqualon Hercules |
| Tobacco - | 44% | Bruton Dry Snuff |
| Propylene Glycol | 3% | Spectrum Chemical |
| Sucralose | 1% | Tate & Lyle |
| Cool Mint Flavor | 2% | Tobacco Technology, Eldersburg, Maryland |

Two pounds of the above composition were mixed using the Cuisinart. The resulting blend was placed using a cone into the Econofloss machine. The Econofloss machine was running at 3450 rpm, with the spinning head temperature at 230° F.

The process resulting in brittle flakes and smoke was observed during the process. The pH of the resulting flakes was measured at 6.83.

Example M

| Ingredient | Percentage of initial composition fed into spinner | Supplier |
|---|---|---|
| HPC ELF | 44% | Aqualon Hercules |
| Tobacco - | 50% | Bruton Dry Snuff |
| Propylene Glycol | 3% | Spectrum Chemical |
| Sucralose | 1% | Tate & Lyle |
| Cool Mint Flavor | 2% | Tobacco Technology, Eldersburg, Maryland |

Two pounds of the above composition were mixed using the Cuisinart. The resulting blend was placed using a cone into the Econofloss machine. The Econofloss machine was running at 3450 rpm.

The process promptly began to smoke and the experiment was discontinued.

Example N

| Ingredient | Percentage of initial composition fed into spinner | Supplier |
|---|---|---|
| HPC ELF | 50% | Aqualon Hercules |
| Tobacco - | 36% | Bruton Dry Snuff |
| Propylene Glycol | 8% | Spectrum Chemical |
| Sugar | .2% | Domino |
| Flavor blend: Air Cured Tobacco and Cool Mint | 1.7% air cured .3% cool mint | Tobacco Technology, Eldersburg, Maryland |
| Calcium Silicate | 2% | Akrochem |

Two pounds of the above composition were mixed using the Cuisinart. The resulting blend was placed using a cone into the breeze machine (using the stock spinning head). The breeze machine was running at 3450 rpm, with the spinning head temperature at 230° F.

The process resulting in flakes and some smoke was observed during the process. The pH of the resulting flakes was measured at 6.83.

Example O

The breeze spinning head was modified to increase the aperture width from the stock width (approximately 5.5 mils) to 30 mils.

| Ingredient | Percentage of initial composition fed into spinner | Supplier |
|---|---|---|
| HPC ELF | 51.8% | Aqualon Hercules |
| Tobacco - | 38% | Bruton Dry Snuff |
| Propylene Glycol | 3% | Spectrum Chemical |
| Sucralose | .2% | Tate & Lyle |
| Flavor blend: Air Cured Tobacco and Cool Mint | 1.7% air cured .3% cool mint | Tobacco Technology, Eldersburg, Maryland |
| Calcium Silicate | 3% | Akrochem |
| Titanium Dioxide | 2% | Spectrum Chemical |

Two pounds of the above composition were mixed using the Cuisinart. The resulting blend was placed using a cone into the breeze machine (using the modified spinning head). The breeze machine was running at 3550 rpm, with the spinning head temperature at 227° F. at 50% power.

The process resulted in larger flakes, and higher output than the examples using the stock breeze head, attributable to the new, wider apertures. No smoking was observed. The pH of the resulting flakes was measured at 7.77.

Example P

| Ingredient | Percentage of initial composition fed into spinner | Supplier |
|---|---|---|
| Polyox WSR N10 | 51.8% | DOW CHEMICAL |
| Tobacco - | 38% | Bruton Dry Snuff |

-continued

| Ingredient | Percentage of initial composition fed into spinner | Supplier |
|---|---|---|
| Propylene Glycol | 3% | Spectrum Chemical |
| Sucralose | .2% | Tate & Lyle |
| Flavor blend: Air Cured Tobacco and Cool Mint | 1.7% air cured .3% cool mint | Tobacco Technology, Eldersburg, Maryland |
| Calcium Silicate | 3.5% | Akrochem |
| Titanium Dioxide | 1.5% | Spectrum Chemical |

Two pounds of the above composition were mixed using the Cuisinart. The resulting blend was placed using a cone into the breeze machine (using the modified spinning head). The breeze machine was running at 3550 rpm, with the spinning head temperature at 224° F. at 25% power.

The process resulted in larger flakes, and higher output than the examples using the stock breeze head, attributable to the new, wider (30 mil) apertures. No smoking was observed. The pH of the resulting flakes was measured at 8.1.

Example Q

| Ingredient | Percentage of initial composition fed into spinner | Supplier |
|---|---|---|
| HPC ELF | 50% | Aqualon Hercules |
| Tobacco - | 36.5% | American Smokeless, South Boston, VA |
| Propylene Glycol | 6% | Spectrum Chemical |
| Sucralose | .2% | Tate & Lyle |
| Flavor blend: Air Cured Tobacco and Cool Mint | 1.7% air cured .3% cool mint | Tobacco Technology, Eldersburg, Maryland |
| Calcium Silicate | 3.5% | Akrochem |
| Titanium Dioxide | 1.8% | Spectrum Chemical |

Two pounds of the above composition were mixed using the Cuisinart. The resulting blend was placed using a cone into the Breeze machine (using the modified spinning head). The Breeze machine was running at 3550 rpm, with the spinning head temperature at 218° F.

The process resulted in larger flakes, and higher output than the examples using the stock breeze head, attributable to the new, wider (30 mil) apertures. No smoking was observed. The pH of the resulting flakes was measured at 7.99.

Example R

A healthy adult user placed a 450 mg pinch of the flakes of Example A in his buccal cavity. The pinch took approximately thirty minutes to dissolve and resulted in excellent tobacco satisfaction.

Example S

A healthy adult user placed a 650 mg pinch of the flakes of Example A in his buccal cavity. The pinch took approximately fifty minutes to dissolve and resulted in excellent tobacco satisfaction.

Example T

| Ingredient | Percentage of initial composition fed into spinner | Supplier |
|---|---|---|
| Polyox WSR N 10 | 50% | Dow Chemical |
| Tobacco - | 36.5% | Bruton Dry Snuff |
| Propylene Glycol | 6% | Spectrum Chemical |
| Sucralose | .2% | Tate & Lyle |
| Flavor blend: Air Cured Tobacco and Cool Mint | 1.7% air cured .3% cool mint | Tobacco Technology, Eldersburg, Maryland |
| Calcium Silicate | 3.5% | Akrochem |
| Titanium Dioxide | 1.8% | Spectrum Chemical |

Two pounds of the above composition were mixed using the Cuisinart. The resulting blend was placed using a cone into the Breeze machine (using the modified spinning head). The Breeze machine was running at 3550 rpm, with the spinning head temperature at 220° F.

The process resulted in excellent flakes, and higher output than the example H using the stock breeze head, attributable to the new, wider (30 mil) apertures. No smoking was observed.

A 700 mg pinch lasted 20 minutes in mouth.

Example U

| Ingredient | Percentage of initial composition fed into spinner | Supplier |
|---|---|---|
| PEO N 80 | 50% | Dow Chemical |
| Tobacco - | 36.5% | American Smokeless, South Boston, VA |
| Propylene Glycol | 6% | Spectrum Chemical |
| Sucralose | .2% | Tate & Lyle |
| Flavor blend: Air Cured Tobacco and Cool Mint | 1.7% air cured .3% cool mint | Tobacco Technology, Eldersburg, Maryland |
| Calcium Silicate | 3.5% | Akrochem |
| Titanium Dioxide | 1.8% | Spectrum Chemical |

Two pounds of the above composition were mixed using the Cuisinart. The resulting blend was placed using a cone into the Breeze machine (using the modified spinning head). The Breeze machine was running at 3550 rpm, with the spinning head temperature at 229° F.

The process resulted in excellent flakes attributable to the new, wider (30 mil) apertures. No smoking was observed. A 700 mg pinch was used by a healthy adult user and took twenty minutes to dissolve.

Example V

| Ingredient | Percentage of initial composition fed into spinner | Supplier |
|---|---|---|
| HPMC | 50% | Spectrum Chemical |

-continued

| Ingredient | Percentage of initial composition fed into spinner | Supplier |
|---|---|---|
| Tobacco - | 36.5 | Bruton Dry Snuff |
| Propylene Glycol | 6% | Spectrum Chemical |
| Sucralose | .2% | Tate & Lyle |
| Flavor blend: 3:1 Air Cured Tobacco and Cool Mint | 2% | Tobacco Technology, Eldersburg, Maryland |
| Calcium Silicate | 3.5% | Akrochem |
| Titanium Dioxide | 1.8% | Spectrum Chemical |

Two pounds of the above composition were mixed using the Cuisinart. The resulting blend was placed using a cone into the Breeze machine (using the modified spinning head). The Breeze machine was running at 3550 rpm, with the spinning head temperature at 300° F. The material would not melt and smoking was observed. The experiment was discontinued. The failure was attributed to the melt characteristics of the HPMC that was tested.

Example W

| Ingredient | Percentage of initial composition fed into spinner | Supplier |
|---|---|---|
| ELF | 37.5% | Spectrum |
| PEO N 80 | 12.5% | DOW |
| Tobacco - | 36.5% | Bruton Dry Snuff |
| Propylene Glycol | 6% | Spectrum Chemical |
| Sucralose | .2% | Tate & Lyle |
| Flavor blend: Air Cured Tobacco and Cool Mint | 1.7% air cured .3% cool mint | Tobacco Technology, Eldersburg, Maryland |
| Calcium Silicate | 3.5% | Akrochem |
| Titanium Dioxide | 1.8% | Spectrum Chemical |

The pH of the mixture was 7.99, the RPM was 3555, and a 30 mil modified head was used. The spinning head temperature was 233° F. Very leafy beautiful flakes were formed without burning. The flakes had excellent taste. A 0.7 gm pinch lasts 60 minutes in the mouth.

It will be apparent to those skilled in the art that various modifications and variations can be made in the methods and compositions of the present invention without departing from the spirit or scope of the invention. Thus, it is intended that the present invention cover any and all modifications and variations of this invention that come within the scope of the claims and their equivalents.

What is claimed is:

1. A smokeless tobacco product comprising a flake made by melt spinning at least one soluble material and tobacco, wherein the resulting flake comprises a matrix of the at least one soluble material and the tobacco distributed in the matrix, the matrix being soluble in a user's mouth and resulting in release of nicotine to the user.

2. The smokeless tobacco product according to claim 1, wherein the at least one soluble material comprises hydroxypropyl cellulose (HPC).

3. The smokeless tobacco product according to claim 1, wherein the tobacco is in the form of small granules under 500 microns.

4. The smokeless tobacco product according to claim 1, wherein the tobacco is in the form of snuff.

5. The smokeless tobacco product according to claim 1, further comprising a mucosal absorbing enhancer.

6. The smokeless tobacco product according to claim 1, further comprising a buffering agent for controlling a pH of the resulting flake.

7. The smokeless tobacco product according to claim 6, wherein the buffering agent is present in an amount to provide the resulting flake with a pH of 6.5 to 9.5 when the product is present in a user's mouth.

8. The smokeless tobacco product according to claim 1, wherein the tobacco is a tobacco having a tobacco specific nitrosamine content less than 3 ppm.

9. The smokeless tobacco product according to claim 1, wherein the product includes less than 20 wt % water.

10. The smokeless tobacco product according to claim 1, wherein the tobacco comprises a tobacco extract.

11. The smokeless tobacco product according to claim 10, wherein an ion exchange resin is combined with the tobacco extract.

12. The smokeless tobacco product according to claim 1, further comprising a flavoring.

13. The smokeless tobacco product according to claim 1, further comprising a plasticizer.

14. The smokeless tobacco product according to claim 1, wherein the at least one soluble material is contained in an amount of at least 30 wt % of the whole product.

15. The smokeless tobacco product according to claim 1, further comprising a preserving non microbial and non fungal agent.

16. The smokeless tobacco product according to claim 1, further comprising a surface tension and interfacial tension modifier.

17. The smokeless tobacco product according to claim 1, wherein the product has an average dissolution time in the human mouth from 3 to 120 minutes.

18. The smokeless tobacco product according to claim 1, wherein the product has an average dissolution time in the human mouth from 5 to 80 minutes.

19. The smokeless tobacco product according to claim 1, wherein the at least one soluble material is solid at room temperature and melts at or below 500° F., carries from 1% to 70% by weight of tobacco when processed through melt spinning, and solidifies again in less than 5 seconds after melt spinning.

* * * * *